US006523521B2

(12) United States Patent
Yokoyama et al.

(10) Patent No.: US 6,523,521 B2
(45) Date of Patent: Feb. 25, 2003

(54) HOT WATER TYPE FIRST IDLE CONTROL DEVICE

(75) Inventors: Takashi Yokoyama, Kakuda (JP); Hideaki Andou, Kakuda (JP)

(73) Assignee: Keihin Corporation, Tokyo (JP)

( * ) Notice: Subject to any disclaimer, the term of this patent is extended or adjusted under 35 U.S.C. 154(b) by 1 day.

(21) Appl. No.: 09/741,158

(22) Filed: Dec. 21, 2000

(65) Prior Publication Data

US 2001/0025623 A1 Oct. 4, 2001

(30) Foreign Application Priority Data

Dec. 24, 1999 (JP) ..... 11-366881

(51) Int. Cl.[7] ..... F02D 9/02; F02M 3/00

(52) U.S. Cl. ..... 123/339.1; 123/339.13; 123/339.22; 123/339.24

(58) Field of Search ..... 123/339.1, 339.13, 123/339.22, 339.24

(56) References Cited

U.S. PATENT DOCUMENTS 4,561,394 A * 12/1985 Kishida et al. ..... 123/179 G
5,687,695 A * 11/1997 Tsukamoto et al. ..... 123/339.1

* cited by examiner

*Primary Examiner*—Willis R. Wolfe
*Assistant Examiner*—Johnny H. Hoang
(74) *Attorney, Agent, or Firm*—Arent Fox Kintner Plotkin & Kahn, PLLC

(57) ABSTRACT

A hot water type first idle control device includes a heating chamber through which cooling water for an engine is allowed to flow, a wax case heated by the heating chamber, and a device housing in which the wax case is accommodated and retained. In the hot water type first idle control device, the heating chamber is integrally defined in the device housing to adjoin the wax case with a partition wall interposed therebetween for separating the heating chamber from the inside of the device housing. Thus, it is possible to effectively heat the wax case by hot water, while preventing the entering of the hot water into the device housing.

3 Claims, 3 Drawing Sheets

HOT WATER TYPE FIRST IDLE CONTROL DEVICE

BACKGROUND OF THE INVENTION

1. Field of the Invention

The present invention relates to a hot water type first idle control device utilizing cooling water for an engine and particularly, to an improvement in a hot water type first idle control device comprising a first idle adjusting member for adjusting the first idling state of an engine, and a temperature-sensitive operating device including a wax case having a wax encapsulated therein, a device housing in which the wax case is accommodated and retained, and a heating chamber through which the cooling water for the engine is allowed to flow to heat the wax, the temperature-sensitive operating device operating the first idle adjusting member in response to a thermal expansion of the wax.

2. Description of the Related Art

Such first idle control devices are conventionally known, as disclosed in Japanese Patent Application Laid-open No.64-29659, for example.

It should be noted here that in such conventionally known first idle control device, the inside of the device housing is formed as the heating chamber, and the wax case is disposed in the heating chamber, as disclosed in the above publication. Therefore, it is necessary to form each of various portions within the wax case into a liquid-tight structure in order that hot water flowing through the heating chamber may be prevented from entering into various portions within the device housing such as the wax case. Therefore, the number of parts is increased and hence, it is difficult to reduce the cost.

SUMMARY OF THE INVENTION

Accordingly, the present invention has been accomplished in view of the above circumstances, and it is an object of the present invention to provide a hot water first idle control device, wherein the wax case can be heated, while preventing of the entering of the hot water into the device housing, whereby a special liquid-tight structure is not required for each of the various portions within the device housing.

To achieve the above object, according to a first aspect and feature of the present invention, there is provided a hot water type idle control device comprising a first idle adjusting member for adjusting the first idling state of an engine, and a temperature-sensitive operating device including a wax case having a wax encapsulated therein, a device housing in which the wax case is accommodated and retained, and a heating chamber through which the cooling water for the engine is allowed to flow to heat the wax, the temperature-sensitive operating device operating the first idle adjusting member in response to the thermal expansion of the wax, wherein the heating chamber is integrally defined in the device housing to adjoin the wax case with a partition wall interposed therebetween for separating the heating chamber from the inside of the device housing.

Meanwhile, the first idle adjusting members correspond to a piston valve 11 and a bypass valve 45 in embodiments of the present invention, which will be described hereinafter.

With the first feature, when the temperature in the heating chamber through the cooling water for the engine is passed is raised with raising of the temperature of the cooling water, a heat in the heating chamber can be propagated through the partition wall to wax to expand the wax, thereby reliably operating the first idle adjusting members. Moreover, the heating chamber is separated from the inside of the device housing and hence, it is possible to reliably prevent the water flowing through the heating chamber from entering into the device housing without employment of a special liquid-tight structure for each of various portions within the device housing, and it is possible to simplify the construction of the temperature-sensitive operating device to an extent corresponding to the unnecessity of the liquid-tight structure to provide a reduction in cost.

According to a second embodiment of the present invention, in addition to the first feature, the device housing is integrally formed with a hose joint for connecting a hose for guiding the cooling water for the engine to bring the hose into communication with the heating chamber.

With the second feature, it is possible to reduce the number of parts to contribute to the further simplification of the construction of the temperature-sensitive operating device.

According to a third embodiment of the present invention, in addition to the first or second feature, the heating chamber is provided with an orifice for limiting the flow rate of water.

With the third feature, the flow rate of water in the heating chamber can be limited properly by selecting a bore diameter of the orifice, thereby controlling the speed of thermal expansion of the wax, i.e., the operational speed of the first idle adjusting members.

The above and other objects, features and advantages of the invention will become apparent from the following description of the preferred embodiment taken in conjunction with the accompanying drawings.

DESCRIPTION OF THE PREFERRED EMBODIMENTS

Figure 1:
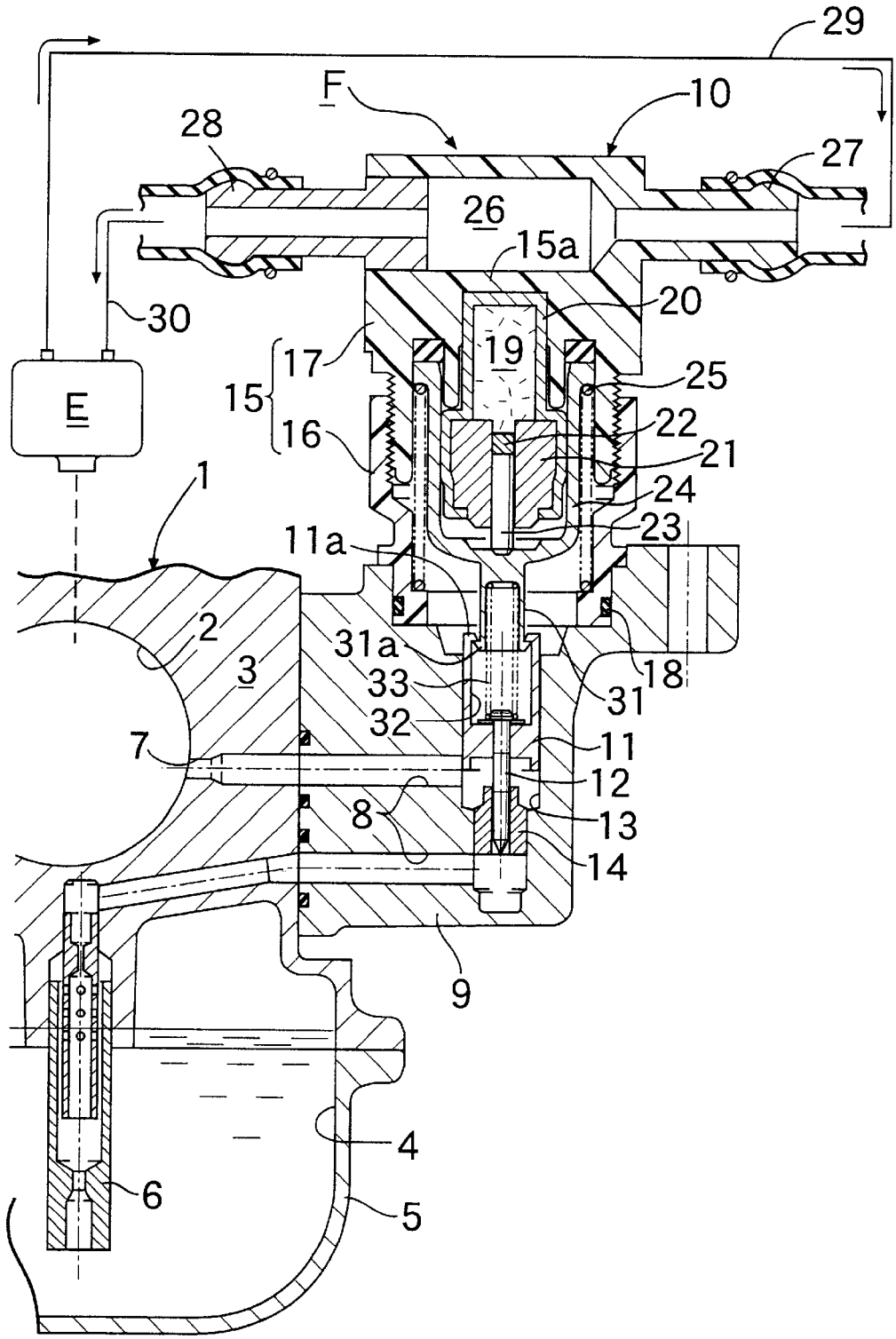
FIG. 1 is a sectional view of a hot water type first idle control device according to a first embodiment of the present invention and a carburetor with the hot water type first idle control device mounted thereto.

A first embodiment of the present invention will now be described with reference to FIG. 1.

A carburetor 1 includes a carburetor body 3 having an intake passage 2 connected to an intake port in an engine E, and a float chamber body 5 coupled to a lower surface of the carburetor body 3 to define a float chamber 4 between the float chamber body 5 and the lower surface of the carburetor body 3. A fuel jet 6 is mounted to the carburetor body 3 and disposed below the level of a fuel oil in the float chamber 4, and an idle port 7 is provided in the carburetor body 3 and opens into the intake passage 2. A fuel passage block 9 is coupled to one side of the carburetor body 3 and has a fuel passage 8 permitting the fuel jet 6 and the idle port 7 to communicate with each other. A hot water type first idle control device F is mounted to the fuel passage block 9 for opening and closing the fuel passage 8 to adjust the amount of fuel injected from the idle port 7.

The hot water type first idle control device F is comprised of a temperature-sensitive operating device 10 operated in accordance with a variation in temperature of cooling water for the engine E, and a piton valve 11 (a first idle adjusting member) for controlling the opening degree of the fuel passage 8 by the operation of the device 10. The piston valve 11 includes a needle valve 12.

A cylindrical valve chest 13 and a needle jet 14 are disposed in line in an intermediate portion of the fuel passage 8. The piston valve 11 is slidably received in the valve chest 13, and the needle valve 12 is inserted into the needle jet 14.

The temperature-sensitive operating device 10 has a device housing 15 mounted to the fuel passage block 9. The device housing 15 comprises a cylindrical housing body 16 fitted and fixed in a mounting bore 9*a* in the fuel passage block 9 with a seal member 18 interposed therebetween, and a housing cap 17 threadedly fitted into the housing body 16. A wax case 20 having a wax 19 encapsulated therein is accommodated and retained within the housing cap 17. The wax case 20 has a rod guide 21 fixedly mounted in one end thereof, and a seal piston 22 contacting at its one end surface to the wax 19 and an output rod 23 abutting against the other end surface of the seal piston 22 are slidably received in the rod guide 21. A bottomed cylindrical operating member 24 is slidably fitted in the housing cap 17, with a tip end of the output rod 23 abutting against an inner end surface of the operating member 24, and a return spring 25 is accommodated in the device housing 15 for biasing the operating member 24 toward the output rod 23.

The housing cap 17 is integrally formed with (1) a heating chamber 26 which adjoins the wax case 20 with a partition wall 15*a* interposed therebetween, so that it is separated from the inside of the housing cap 17, and (2) a first hose joint 27 protruding outwards from one end of the chamber 26 on one side of the housing cap 17. A second hose joint 28 is fitted into and welded in the other end of the heating chamber 26 to protrude outwards therefrom on the other side of the housing cap 17. The housing cap 17, the heating chamber 26 and the fist hose joint 27 are formed integrally one another, using a synthetic resin as a material.

A hot water supply hose 29 for withdrawing the cooling water from a cooling water jacket of the engine E is connected to one of the first and second hose joints 27 and 28, and a hot water circulating hose 30 for circulating the hot water into the cooling water jacket of the engine E is connected to the other of the first and second hose joints 27 and 28.

The operating member 24 is integrally provided at its outer end surface with a connecting shaft 31 arranged coaxially with the output rod 23. The connecting shaft 31 is slidably received in a connecting bore 32, which opens into an outer end of the piston valve 11. An outward-directed flange 31*a* is formed at a tip end of the connecting shaft 31, and an inward-directed flange 11*a* is formed at an open end of the connecting bore 32, so that limits of sliding movements of the connecting shaft 31 and the piston valve 11 in expanding directions are defined by abutment of the flanges 31*a* and 11*a* against each other. A connecting spring 33 is mounted under compression between the connecting shaft 31 and the piston valve 11 for biasing the connecting shaft 31 and the piston valve 11 in the expanding directions.

The operation of the first embodiment will be described below.

In a cold season, the wax 19 in the wax case 20 is in a shrunk state and hence, the operating member 24 is in a retracted state with the output rod 23 forced into the wax case 20 under the action of a biasing force of the return spring 25. At that time, the connecting shaft 31 of the operating member 24 and the piston valve 11 are retained in connected states with the outward-directed flange 31*a* and the inward-directed flange 11*a* being in abutment against each other under the action of the biasing force of the connecting spring 33, and hence, the piston valve 11 is raised to pull up the needle valve 12 to control the opening degree of the needle jet 14 to a relatively large value. Therefore, when the engine E is started in this state, the engine E draws (1) air passed through the intake passage 2 with its flow rate controlled by a throttle valve (not shown), and (2) a relatively large amount of fuel injected from the idle port 7 and thus, the engine E can be started easily. Even if the engine E enters a warmed operational state, it continues to draw a relatively large amount of fuel in the same manner as described above, and hence, a predetermined first idling rotational speed is provided, and the warming of the engine is promoted.

During operation of the engine E, a portion of the cooling water for the engine E is circulated sequentially through the engine E, the hot water supply hose 29, the heating chamber 26, the hot water circulating hose 30 and the engine E. Therefore, if the warming operation of the engine E is advanced, resulting in a rise in temperature of the cooling water, the temperature of the inside of the heating chamber 26 is also raised. The heat in the heating chamber 26 is propagated through the partition wall 15*a* and the wax case 20 to the wax 19 to expand the wax 19. When the wax 19 has been expanded, the output rod 23 is urged by the wax 19 to advance the operating member 24 against the biasing force of the return spring 25 and hence, the piston valve 11 is displaced in a closing direction along with the needle valve 12 to throttle the needle jet 14. As a result, the amount of fuel injected from the idle port 7 is reduced, whereby the first idle rotational speed of the engine E is reduced. When the piston valve 11 is closed to come into contact with the end surface of the valve chest 13, the fuel passage 8 is blocked, whereby the injection of the fuel from the idle port 7 is stopped to bring the engine E into a usual idling state.

It should be noted here that the heating chamber 26 in the temperature-sensitive operating device 10 is integrally defined in the housing cap 17 to adjoin the wax case 20 with the partition wall 15*a* interposed therebetween for separating the heating chamber 26 from the inside of the housing cap 17. Therefore, it is possible to reliably prevent the hot water flowing through the heating chamber 26 from entering into the device housing 15 without employment of a special liquid-tight structure for each of various portions within the device housing 15. Thus, the construction of the temperature-sensitive operating device 10 can be simplified to an extent corresponding to the unnecessity of the liquid-tight structure to contribute to a reduction in cost.

Figure 2:
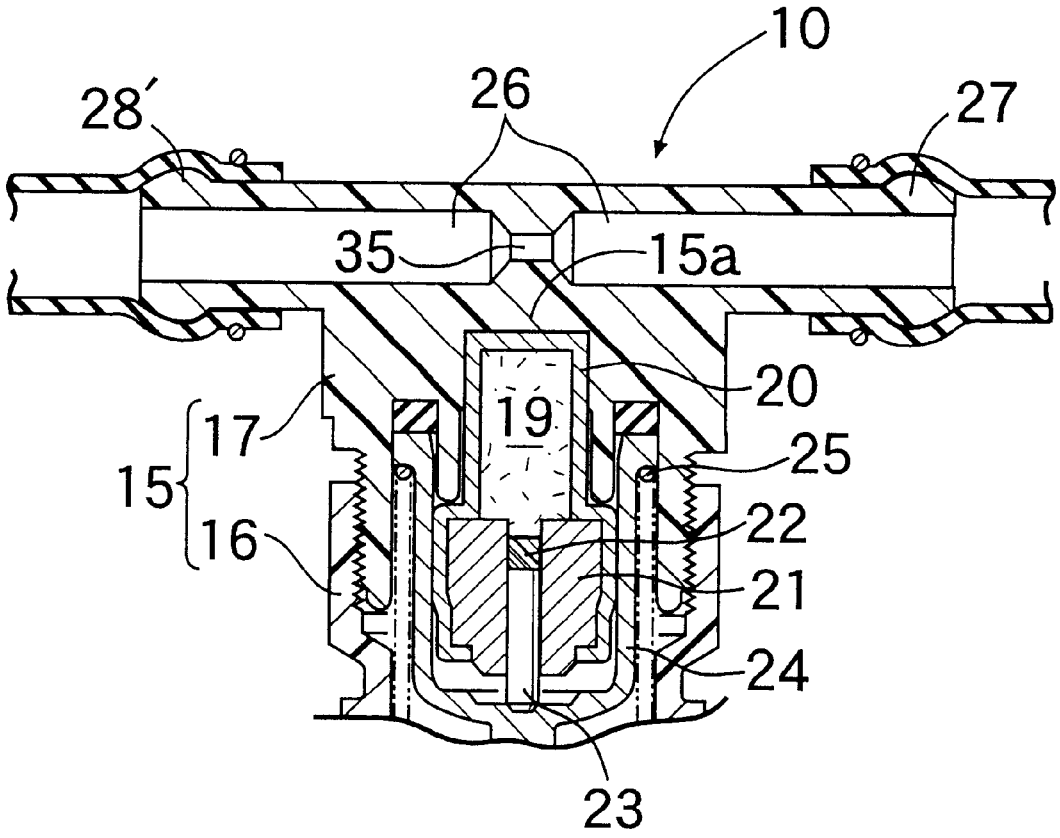
FIG. 2 is a sectional view of an essential portion of a hot water type first idle control device according to a second embodiment of the present invention.

In a second embodiment shown in FIG. 2, first and second hose joints 27 and 28' arranged coaxially with each other are formed integrally on a housing cap 17, and a heating chamber 26 is defined between the house joints 27 and 28' so as to be continuous with the house joints 27 and 28'. Further, a flow rate limiting orifice 35 is provided in a central portion of the heating chamber 26. The other arrangement is similar to that in the previous embodiment and hence, portions or components corresponding to those in the previous embodiment are designated by like reference characters and the description of them is omitted.

According to the second embodiment, the number of parts is reduced, and at the same time, the arrangement can be further simplified, by the integral formation of the housing cap 17, the heating chamber 26 and the first and second hose joints 27 and 28'. In addition, the flow rate of the hot water in the heating chamber 26 can be limited to a given value by selection of a bore diameter of the orifice 35, thereby controlling the speed of thermal expansion of the wax 19 and thus the opening speed of the piston valve 11.

Finally, a third embodiment of the present invention will be described below with reference to FIG. 3.

The third embodiment is different from the two previous embodiments in that the first idle control device F according to the present invention is applied to a fuel injection engine.

A throttle valve 42 for opening and closing the intake passage 40 is pivotally supported in a throttle body 41 having an intake passage 40 connected to an intake port in an engine E. A bypass passage 43 is defined in one sidewall of the throttle body 41 to detour around the throttle valve 42 to communicate with the intake passage 40, and an electromagnetic fuel injection valve 44 capable of injecting fuel toward the intake port in the engine E is mounted to the other sidewall of the throttle body 41.

A piston-type bypass valve 45 is provided in the bypass passage 43 for adjusting the opening degree of the bypass passage 43. The bypass valve 45 serves to control the amount of idle air drawn into the engine E through the bypass passage 43 when the throttle valve 42 is in a fully closed state.

A temperature-sensitive operating device 10 and an adjusting bolt 47 are connected to the bypass valve 45 through a lever member 48.

The lever member 48 is secured to a pivot 49 rotatably supported on the throttle body 41 by a machine screw 55. The lever member 48 is formed by pressing a steel plate. The lever member 48 has its intermediate portion secured to the pivot 49 and is provided on one end side of the intermediate portion with a connection tube 50 and a connection fork 51 and on its other end side with an arm 52. An extension rod 53 connected to the operating member 24 of the temperature-sensitive operating device 10 is connected to the connection tube 50 through a pin 54, and the connection fork 51 is connected to the bypass valve 45. A tip end of the idle adjusting bolt 47 threadedly fitted in the throttle body 41 abuts against the arm 52.

Integrally formed on the housing cap 17 of the temperature-sensitive operating device 10 are a first hose joint 27 extending coaxially with the heating chamber 26, and a second hose joint 28' bent at a right angle from an end of the heating chamber 26 and extending in parallel to the idle adjusting bolt 47.

Figure 3:
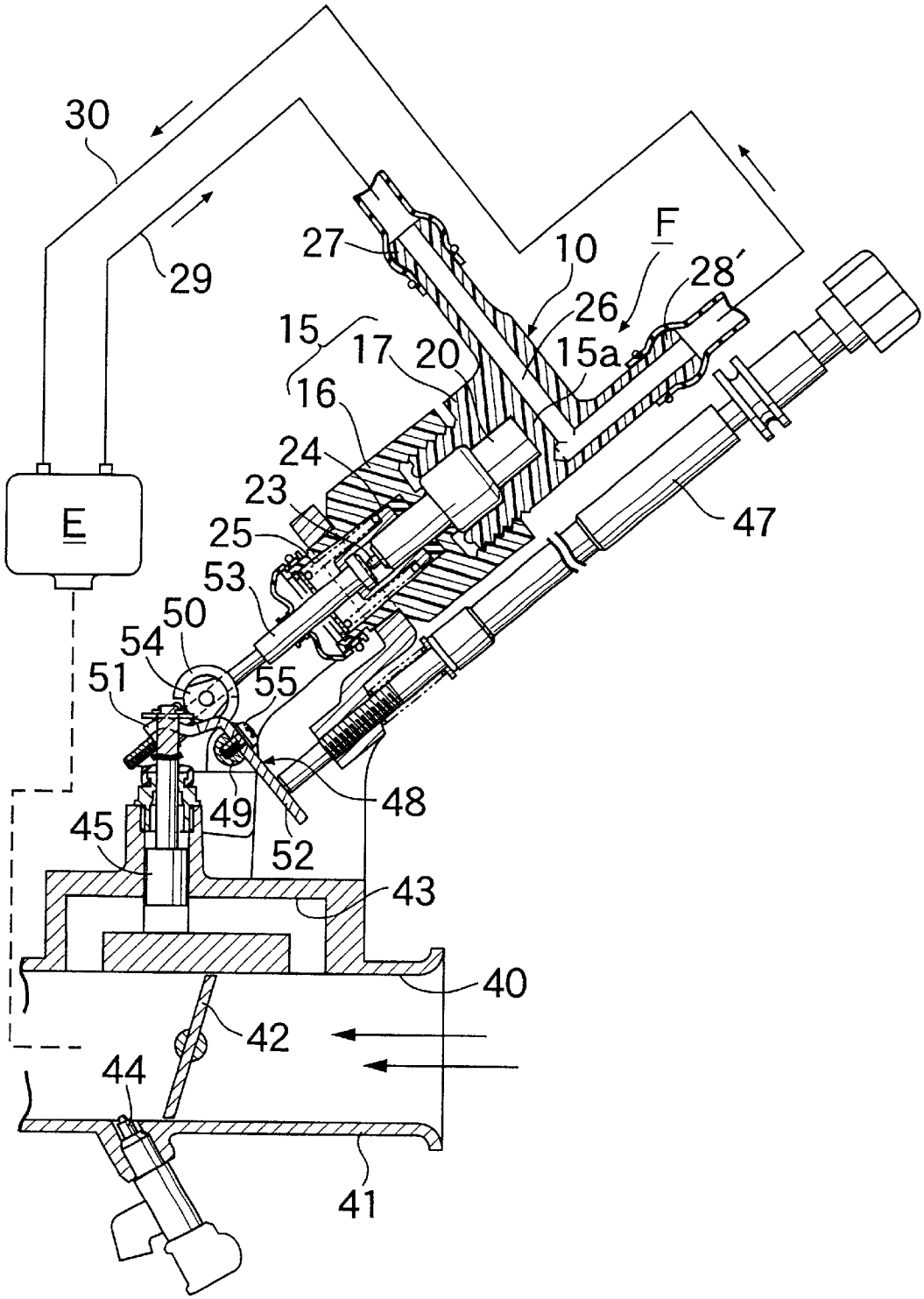
FIG. 3 is a sectional view of a hot water type first idle control device according to a third embodiment of the present invention and a throttle body with the hot water type first idle control device mounted thereto.

Except for the above-described arrangement, the temperature-sensitive operating device 10 is of the same arrangement as the temperature-sensitive operating device 10 in the first embodiment and hence, portions or components corresponding to those in the first embodiment are designated by like reference characters in FIG. 3, and the description of them is omitted.

The operation of the third embodiment will be described below. In a cold season, the wax in the wax case 20 is in a shrunk state and hence, the operating member 24 is in a retracted state with the output rod 23 pushed in the wax case 20 under the action of the biasing force of the return spring 25. At that time, the extension rod 53 connected to the operating member 24 pulls up the bypass valve 45 through the lever member 48 to retain it at a location of a high-opening degree. Therefore, when the throttle valve 42 is in a fully closed state, the engine E draws a relatively large amount of air through the bypass passage 43 to assume a first idling state.

When the warming operation of the engine E is advanced to raise the temperature of the heating chamber 26 in the temperature-sensitive operating device 10 with raising of the temperature of the cooling water for the engine E, the operating member 24 and the extension rod 53 are advanced against the biasing force of the return spring 25 by the thermal expansion of the wax in the wax case 20 to push down the bypass valve 45 through the lever member 48 to reduce the opening degree of the bypass valve 45, and ultimately to retain the bypass valve 45 at a location of a minimum idling opening degree. Therefore, the amount of air drawn into the engine E through the bypass passage 43 is brought into a minimum value, whereby the engine E is brought into a usual idling state. In this case, the minimum amount of air drawn into the engine E can be increased or decreased by advancing or retracting the adjusting bolt 47 relative to the lever member 48 to adjust the minimum opening degree of the bypass valve 45.

In the housing cap 17 of the temperature-sensitive operating device 10, the first hose joint 27 is disposed coaxially with the heating chamber 26, and the second hose joint 28' is bent at the right angle from the end of the heating chamber 26 and disposed in parallel to the idle adjusting bolt 47. Therefore, the integral formation of the housing cap 17, the heating chamber 26 and the first and second hose joints 27 and 28' from the synthetic resin is facilitated, whereby the compactness of the first idle control device F can be achieved, while avoiding the interference of the second hose joint 28' and the adjusting bolt 47 with each other.

Although the embodiments of the present invention have been described in detail, it will be understood that the present invention is not limited to the above-described embodiments, and various modifications in design may be made without departing from the spirit and scope of the invention defined in claims.

What is claimed is:

1. A hot water first idle control device comprising a first idle adjusting member for adjusting a first idling state of an engine, and a temperature-sensitive operating device including a wax case having a wax encapsulated therein, a device housing in which the wax case is accommodated and retained, and a heating chamber through which cooling water for the engine is allowed to flow, said temperature-sensitive operating device operating said first idle adjusting member in response to a thermal expansion of said wax, wherein said heating chamber is integrally defined in said device housing to adjoin said wax case with a partition wall interposed therebetween for separating said heating chamber from an inside of said device housing.

2. A hot water first idle control device according to claim 1, wherein said device housing is integrally formed with a hose joint for connecting a hose for guiding the cooling water for the engine to bring said hose into communication with said heating chamber.

3. A hot water first idle control device according to claim 1 or 2, wherein said heating chamber is provided with an orifice for limiting a flow rate of water.

* * * * *